US006296249B1

(12) United States Patent
Mogensen

(10) Patent No.: US 6,296,249 B1
(45) **Date of Patent: *Oct. 2, 2001**

(54) DISC TOSSING/TARGET RECEIVING GAME WITH SURFACE FEATURES

(75) Inventor: Steven Allen Mogensen, Lakeville, MN (US)

(73) Assignee: Allied Development Corporation, Lakeville, MN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/136,060

(22) Filed: Aug. 19, 1998

(51) Int. Cl.[7] ..... A63F 3/00
(52) U.S. Cl. ..... 273/126 R; 273/400
(58) Field of Search ..... 273/401, 402, 273/336, 337, 338, 339, FOR 224, FOR 225; 473/588, 589

(56) References Cited

U.S. PATENT DOCUMENTS 248,901 * 11/1881 Wetherill ..... 473/589
1,167,452 * 1/1916 Ward ..... 273/126 R
2,126,245 * 8/1938 Darby ..... 273/400 X
3,386,737 * 6/1968 Burgess ..... 273/126 R
4,204,682 * 5/1980 Brown ..... 273/401
4,877,256 * 10/1989 Falloon ..... 273/400
4,974,858 * 12/1990 Knowlton ..... 273/401
5,056,797 * 10/1991 Hockert et al. ..... 273/402
5,110,139 * 5/1992 Baumgartner ..... 273/400
5,575,480 * 11/1996 Wehr ..... 273/402

* cited by examiner

*Primary Examiner*—Sam Rimell

(57) ABSTRACT

A disc tossing game for use by one or more players. In the playing mode a generally rectangular target with convex landing surface and pockets is deployed in a spaced apart relationship to the players. Discs are tossed onto the target apparatus to score points according to the rules. The entirety of the discs and the target apparatus create the appearance of impossibility with respect to the discs entering certain scoring areas, while at the same time creating the possibility of developing a variety of skills such that the aforementioned scoring areas can indeed be entered.

43 Claims, 2 Drawing Sheets

DISC TOSSING/TARGET RECEIVING GAME WITH SURFACE FEATURES

BACKGROUND OF THE INVENTION

1. Field of Invention

The present invention relates to games composed of a target apparatus and discs tossed onto the target apparatus.

2. Description of the Prior Art

A number of disc tossing games are known in the prior art. One prior art version is disclosed in U. S. Pat. No. 2,126,245, which issued to W. A. Darby on Aug. 9, 1938, and describes tossing a disc through the air directly into a target bag mounted on a framework . This patent shows the disc is intentionally modified to a design that makes it sensitive to air currents and increases the element of chance in the game.

U.S. Pat. No. 4,877,256 to D. Falloon shows a tossing game wherein annular disks or rings are thrown toward a target device located on a ground or floor surface. The target device comprises a relatively large upstanding box or tray. Three relatively small upright tubes of graduated height are arranged within the box. The object of the game is to land a disk in the tallest cup, or in the alternative, the other cups or box area surrounding the cups from a point approximately 15 feet away. One disadvantage of the game shown in U.S. Pat. No. 4,877,256 is that when the disk strikes the edge of a cup or the upper edge of the box it is apt to rebound away from the target device. The game tends to reward the lucky player, not the player with the most skill. Errant bounces also increase the potential for damage from playing the game.

U.S. Pat. No. 5,056,797 discloses a tossing game where the surface of the target apparatus is cushioned and angled toward the player in order to provide a game having a target surface tending to cause a disk to stay on, or at least close to, its initial landing point on the target surface.

U.S. Pat. No. 5,110,139 discloses a tossing game where assembly is required for the target apparatus. This adds expense and complication to the game.

It is immediately apparent from entirety of the discs and target apparatus in these games how the discs can make their way into the scoring areas. The preferred method is for the disc to enter the scoring area directly from the toss without touching the target surface. This too is as disadvantage and reduces the challenge and interest of these games.

SUMMARY OF THE INVENTION

The present invention, which will be described subsequently in greater detail, comprises a target apparatus, a plurality of discs, and playing instructions. The target apparatus and discs are designed in such a way that the interaction between the target apparatus and discs are unexpected and varied.

The design of the target apparatus must take into account its structural strength, resistance to weathering elements, resistance to damage when played, and the impact of the design on the interaction between the target apparatus and the discs.

The design of the discs must take into account the structural strength of the discs, resistance to weathering elements, resistance to damage when played, the interaction of the discs with the player, the interaction of the discs with the elements, and the interaction of the discs with the target apparatus.

It is therefore the objective of the present invention to provide a challenging game of skill and strategy while eliminating the standard methods and creating new methods for successfully putting playing pieces into scoring areas. The ability to eliminate the old methods and create the new depends on many variables such as the geometric layout of the playing surface, pockets, vertical flange, and horizontal flange; the geometric layout of the discs and inserts; and the materials and surface textures used for both the target apparatus and the discs.

For example, it is nearly impossible to toss the discs directly into the pockets of the planar surface of the present invention because of the selection of the configuration of variables listed hereinabove for the target apparatus and the discs. Games in the prior art depend exclusively on this method of successfully placing the playing pieces into the scoring areas. The current invention requires more interesting and challenging means of successfully placing the discs into scoring positions.

Errant bounces of the discs experienced with past games are nearly eliminated by the current invention. This greatly increases the importance of skill and reduces the component of chance involved in scoring points. The lack of errant bounces also eliminates the chance of causing damage from playing the game.

Due to the selection of the configuration of variables listed hereinabove for the target apparatus and the discs, the discs are tossed approximately six feet from the target apparatus. Prior art games are played from much greater distances. This distance reduction improves safety and causes skill to be more important than luck when playing the game.

No assembly is required for either the discs or the target apparatus. This creates a game that is easy and simple to use, but is also economical to manufacture.

Other objects, advantages and applications of the present invention will become apparent to those skilled in the art of disc tossing/target receiving games when the accompanying description of one example of the best mode contemplated for practicing the invention is read in conjunction with the accompanying drawings.

BRIEF DESCRIPTION OF THE DRAWINGS

The description herein makes reference to the accompanying drawing wherein like reference numerals refer to like parts throughout the several views, and wherein.

DESCRIPTION OF THE PREFERRED EMBODIMENTS

EXAMPLE 1

Figure 1:
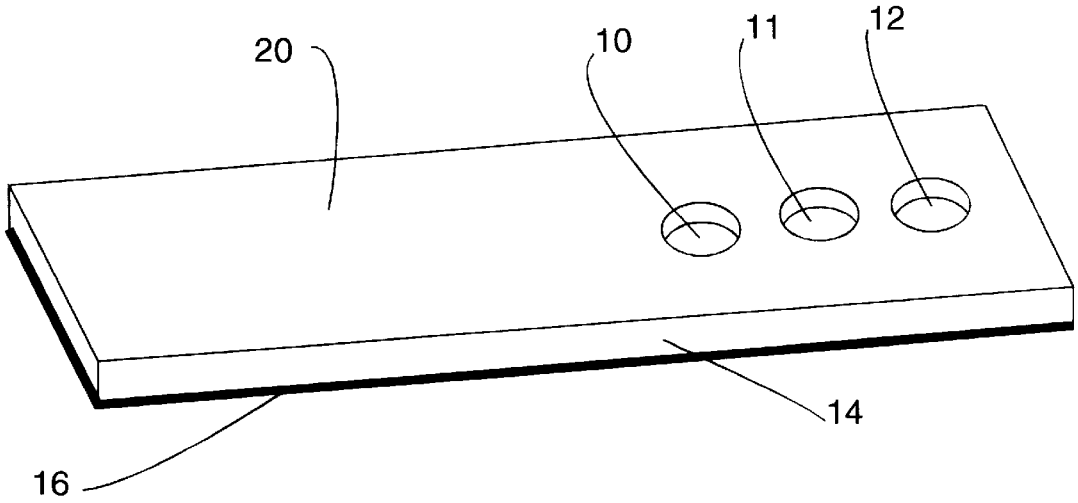
FIG. 1 is a perspective view of the target apparatus in accordance with the principles of the present invention.
Figure 2:
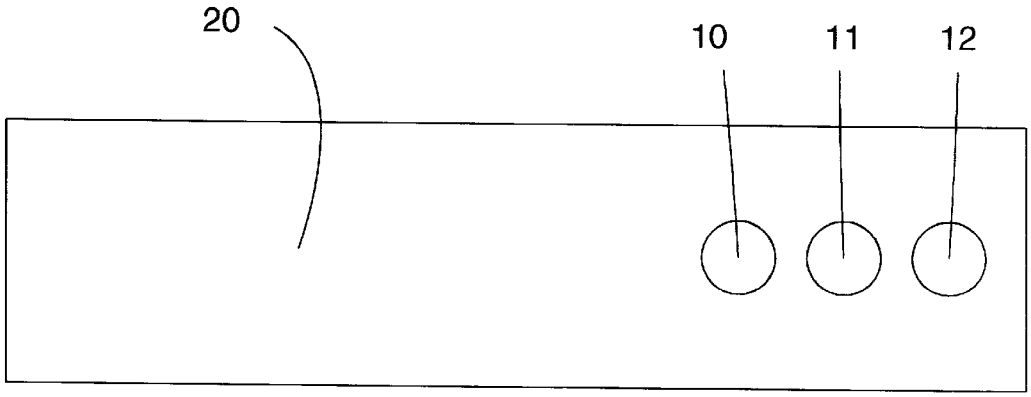
FIG. 2 is a reduced top view of the target apparatus illustrated in FIG. 1.

Referring now to the drawings and, in particular, to FIG. 1, there is illustrated one example of the present invention in the form of a target apparatus with a minimally convex playing surface 20, three pockets 10,11,12, a vertical flange 14 around the entire circumference of the playing surface, and a horizontal flange 16 around the entire circumference of the vertical flange.

The convex playing surface 20 causes the discs to veer away from the pockets 10, but the convex nature of the playing surface is not normally noticed. This creates the appearance of a possibility of sliding the discs into pockets 11 and 12, when it is in fact nearly impossible.

The vertical flange 14 creates sufficient depth to allow at least six discs to fall into each pocket.

The horizontal flange 16 is added for increased structural strength and an aesthetically pleasing use and handling of the target apparatus.

The entire target apparatus is composed of essentially acrylonytrile styrene butadiene "ABS" resin with additives for color and UV light stability.

The playing surface of the target apparatus is covered with an integral texture that reduces friction, improves wearability, and enhances play of the game.

Figure 3:
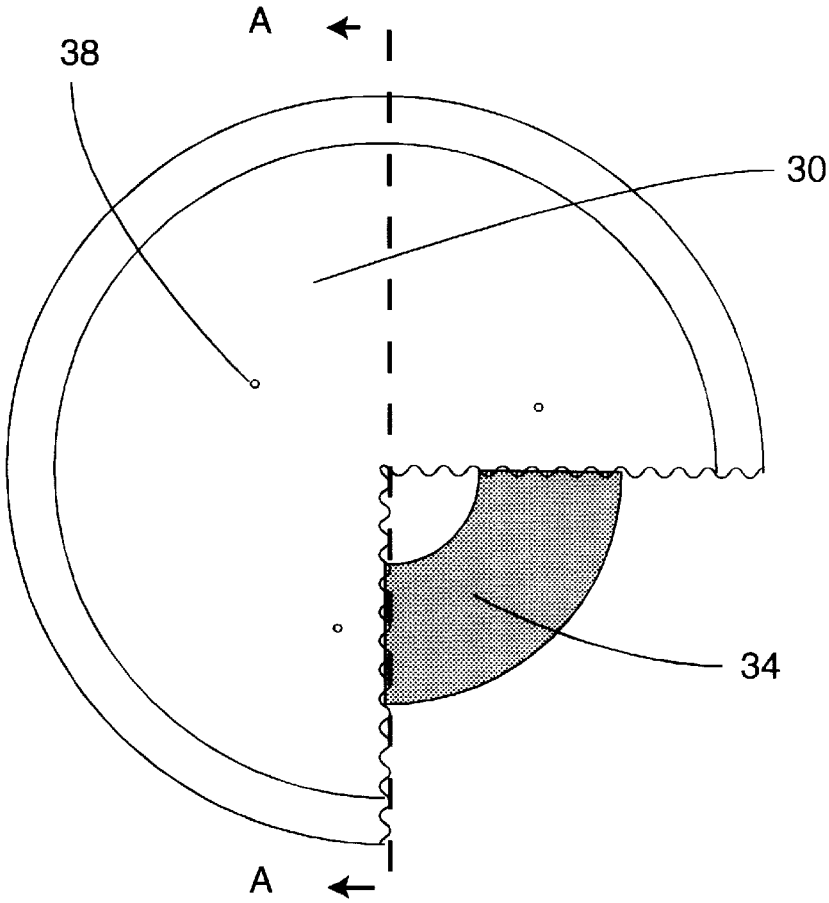
FIG. 3 is an enlarged perspective view of a disc. It is of a partially exposed nature to illustrate the relation of the insert and outer construction of the disc, the partially exposed nature and the portions conventionally shown as broken away, being to illustrate interior details otherwise hidden.
Figure 4:
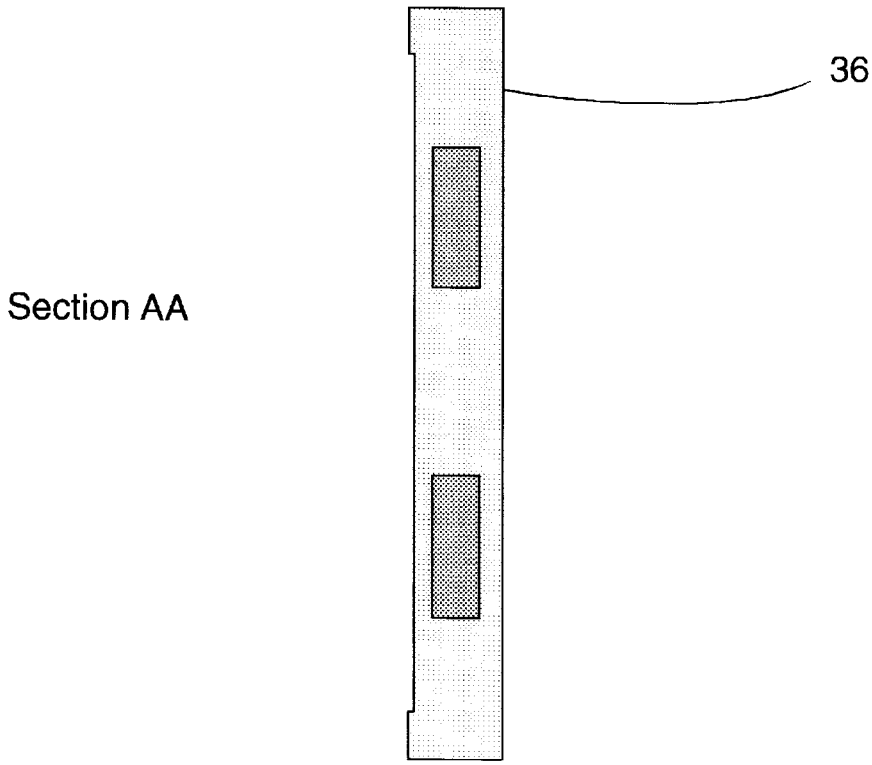
FIG. 4 is a section view through the disc illustrated in FIG. 3.

In FIG. 3 the disc is illustrated with a plastic construction 30 and a metal insert 34. The lastic construction 30 is essentially styrene with additives for color. The metal insert 34 is zinc coated steel. The playing surface 36 of the plastic construction 30 is covered with an integral texture that reduces friction, improves wearability, and enhances play of the game. As can best be seen in FIGS. 3 and 4, the metal insert 34 is completely encompassed by the plastic construction 30 with the exception of three small holes 38 on each side of the metal insert 34.

The interaction between the target apparatus and the disc is important as it defines the characteristics of the game. One important parameter is the friction between the target apparatus and the discs. The results for this embodiment is a static coefficient of friction between the discs and the playing surface of 0.2.

This invention is further illustrated by the following examples:

EXAMPLE 2

Example 2 is the same as example 1 except the playing surface 20 of the target apparatus is made planar instead of convex. This significantly reduces the difficulty of accomplishing the discs into the scoring pockets 10, 11 and 12 and most particularly reduces the difficulty of accomplishing the discs into the scoring pockets 11 and 12.

EXAMPLE 3

Example 3 is the same as example 1 except the playing surface 20 of the target apparatus and the playing surface 36 of the disc are smooth rather than textured. The coefficient of friction increases reducing the difficulty of accomplishing the discs into the scoring pockets 10,11, and 12.

EXAMPLE 4

Example 4 is the same as example 1 except the metal insert 34 is displaced by additional plastic in the construction of the disc. The weight of the disc is reduced from approximately 2 grams to approximately 1 gram. This significantly increases the difficulty of accomplishing the discs into the scoring pockets 10, 11 and 12. The interaction of the discs and target apparatus result in a game that is challenging and great fun. By an interesting selection of the design parameters described hereinabove, the skill element of the game is retained to a great degree, unlike so many other games that depend almost solely on random luck. In addition to the design parameters described hereinabove, dramatic variations in the playability of the game can be accomplished by adjusting the distance between the player and the target apparatus. Other dramatic variations can be achieved by playing with modified scoring rules.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is as follows:

1. A disc-tossing game, comprising:

a generally rectangular target apparatus fabricated from plastic, having a compliant and uniformly molded plastic, generally planar, top area defining a top playing surface of a size and thickness to allow for a disc-landing area and a top surface area surrounding scoring pockets;

a plurality of scoring pockets in the target apparatus each surrounded by the top playing surface, the depth of the pockets being such that at least one disc can be deposited in each of the pockets;

the pockets having a diameter relative to the size of the discs to allow the discs to enter, and an arrangement such that access to pockets beyond a first pocket is limited; and a plurality of discs, each of the discs having a major outer surface fabricated from plastic, and wherein the interaction of the discs and the top playing surface controls disc bounce and provides a sufficiently low coefficient of friction to promote disc sliding characteristics.

2. The disc-tossing game as set forth in claim 1, wherein the top playing surface is substantially planar and promotes sliding of the discs.

3. The disc-tossing game as set forth in claim 1, wherein the top playing surface has a texture designed to reduce friction.

4. The disc-tossing game as set forth in claim 1, wherein the discs include a metal insert.

5. The disc-tossing game as set forth in claim 1, in a combination in which a playing surface of the discs is fabricated with a smooth surface to increase the coefficient of friction.

6. The disc-tossing game as set forth in claim 1, wherein a circumferential lip is included on at least one side of the discs.

7. The disc-tossing game as set forth in claim 4, wherein there are at least three holes in the plastic of a major surface of the discs to facilitate holding the metal insert in place during fabrication of the plastic.

8. The disc-tossing game as set forth in claim 1, wherein the static coefficient of friction between one of the plurality of discs and the top playing surface is approximately 0.2.

9. The disc-tossing game as set forth in claim 1, wherein the top playing surface is convex.

10. The disc-tossing game as set forth in claim 1, wherein the top playing surface is fabricated to produce a convex disc-landing area.

11. The disc-tossing game as set forth in claim 1, wherein each one of the plurality of discs further comprises:

a raised lip on the disc.

12. The disc-tossing game as set forth in claim 1, wherein each one of the plurality of discs comprises:

a major outer surface and an outer circumference fabricated of plastic; and a least one major outer surface having texture to reduce sliding friction.

13. The disc-tossing game as set forth in claim 1, wherein each one of the plurality of discs is fabricated to produce one major outer surface having a substantially smooth surface.

14. The disc-tossing game as set forth in claim 1, wherein each one of the plurality of discs comprises a metal insert, and wherein there are at least three holes in the plastic of a major surface of the disc to facilitate holding the metal insert in place during fabrication.

15. The disc-tossing game as set forth in claim 1, wherein each one of the plurality of discs is a cylinder having a circular outer circumference.

16. A disc-tossing game, comprising:

a generally rectangular target apparatus fabricated from plastic, having a plastic top area defining a playing surface of a size and thickness to allow for a disc-landing area and an area for scoring pockets;

a plurality of scoring pockets each surrounded by the playing surface, the depth of the pockets being such that at least one disc can be deposited in each of the pockets;

the pockets having a diameter relative to the size of the discs to allow the discs to enter, and an arrangement such that access to pockets beyond a first pocket is limited; and a plurality of discs, each of the discs having a major outer surface fabricated from plastic, and wherein the interaction of the discs and the playing surface control disc bounce and improve disc sliding characteristics, and wherein the disc-landing area of the playing surface is convex.

17. The disc-tossing game as set forth in claim 16, wherein the playing surface is compliant and uniformly molded.

18. The disc-tossing game as set forth in claim 16, wherein the static coefficient of friction between one of the plurality of discs and the top playing surface is approximately 0.2.

19. The disc-tossing game as set forth in claim 16, wherein a circumferential lip is included on at least one side of the discs.

20. The disc-tossing game as set forth in claim 16, wherein the playing surface is substantially smooth.

21. The disc-tossing game as set forth in claim 16, wherein the discs include a metal insert.

22. The disc-tossing game as set forth in claim 16, wherein the playing surface is textured, to improve sliding friction.

23. The disc-tossing game as set forth in claim 22, wherein there are at least three holes in the plastic of a major surface of the discs to facilitate holding the metal insert in place during fabrication of the plastic.

24. The disc-tossing game as set forth in claim 16, in a combination in which at least one playing surface of each disc is fabricated with a smooth surface to increase the coefficient of friction.

25. A projectile-tossing game comprising:

a target apparatus having a compliant and uniformly molded playing surface fabricated from plastic, the playing surface having plurality of pockets including a first and a second pocket, surrounded by a top target surface of a size to allow for a projectile-landing area, the projectile landing area configured to control projectile bounce and improve projectile sliding characteristics, each one of said pockets configured such that at least one projectile can be deposited in said pocket, and the second pocket having a size and position relative to the size and position of the first pocket such that access to the second pocket is limited by the first pocket.

26. The projectile-tossing game as set forth in claim 25, wherein the playing surface is fabricated to produce a substantially planar projectile landing area.

27. The projectile-tossing game as set forth in claim 25, wherein the projectile landing area has a substantially smooth surface to increase friction between the projectile landing area and a tossed projectile.

28. The projectile-tossing game as set forth in claim 25, wherein an outer circumference of the projectile landing area is substantially rectangular and is surrounded by a vertical flange that is in turn surrounded by a horizontal flange, wherein the projectile landing area, the vertical flange, and the horizontal flange are formed of plastic, and wherein the projectile landing area surface has an integral texture.

29. The projectile-tossing game as set forth in claim 25, further comprising a plurality of projectile discs.

30. The projectile-tossing game as set forth in claim 29, wherein the projectile discs are cylindrical and comprise a major outer surface and an outer circumference made of plastic.

31. A projectile-tossing game comprising:

a target apparatus having a playing surface fabricated from plastic, the playing surface having plurality of pockets including a first and a second pocket, surrounded by a top target surface of a size to allow for a top projectile-landing area, the top projectile landing area configured to control projectile bounce and improve projectile sliding characteristics, wherein the pockets are configured such that at least one projectile can be deposited in said pocket, and the second pocket having a size and position relative to the size and position of the first pocket such that access to the second pocket is limited by the first pocket, and wherein at least a portion of the top target surface is fabricated to produce a convex top projectile landing area.

32. The disc-tossing game as set forth in claim 31, wherein the playing surface is compliant and uniformly molded.

33. The projectile-tossing game as set forth in claim 31, wherein the projectile landing area has a substantially smooth surface to increase friction between the projectile landing area and a tossed projectile.

34. The projectile-tossing game as set forth in claim 31, further comprising a plurality of projectile discs.

35. The projectile-tossing game as set forth in claim 31, wherein an outer circumference of the projectile landing area is substantially rectangular and is surrounded by a vertical flange that is in turn surrounded by a horizontal flange, wherein the projectile landing area, the vertical flange, and the horizontal flange are formed of plastic, and wherein the projectile landing area surface has an integral texture.

36. The projectile-tossing game as set forth in claim 35, wherein the projectile discs are cylindrical and comprise a major outer surface and an outer circumference made of plastic.

37. A disc-tossing game, comprising:

a generally rectangular plastic target apparatus, having a playing surface with a generally planar, convex, top disc-landing area and an area for a plurality of scoring pockets including a first pocket, the pockets configured such that at least one disc can be deposited in each of the pockets, the pockets having a diameter relative to the size of the discs and an arrangement such that access to those pockets beyond the first pocket is limited; and a plurality of projectile discs, each of the projectile discs having a major outer surface and an outer circumference made of plastic, and having a metal insert at least partially enclosed by plastic;

wherein the plastic disc-landing surface is configured to facilitate a sliding motion of projectile discs thrown onto the disc-landing surface.

38. The disc-tossing game as set forth in claim 37, wherein the projectile discs are cylindrical.

39. The disc-tossing game as set forth in claim 38, wherein an outer circumference of the disc-landing area is substantially rectangular and is surrounded by a vertical flange that is in turn surrounded by a horizontal flange, wherein the disc-landing area, the vertical flange, and the horizontal flange are formed of plastic, and wherein the disc-landing area has an integral texture.

40. The disc-tossing game as set forth in claim 37, wherein the disc-landing area has a substantially smooth surface to increase friction between the disc-landing area and a tossed disc.

41. The disc-tossing game as set forth in claim 40, wherein the projectile discs are fabricated with at least one major outer surface is fabricated with a smooth surface to increase the coefficient of friction.

42. The disc-tossing game as set forth in claim 37, wherein the projectile discs are fabricated with at least one major outer surface textured.

43. The disc-tossing game as set forth in claim 37, wherein the playing surface is compliant and uniformly molded.

* * * * *